US005202214A

United States Patent [19]

Kawamorita et al.

[11] Patent Number: 5,202,214

[45] Date of Patent: Apr. 13, 1993

[54] PROCESS OF PRODUCING-ELECTROPHOTOGRAPHIC PHOTOSENSITIVE MEMBER

[75] Inventors: Yoichi Kawamorita, Yokohama; Hisao Maruyama, Kamakura; Shin Nagahara, Tokyo, all of Japan

[73] Assignee: Canon Kabushiki Kaisha, Tokyo, Japan

[21] Appl. No.: 629,451

[22] Filed: Dec. 18, 1990

[30] Foreign Application Priority Data

Dec. 19, 1989 [JP] Japan ..... 1-327156

[51] Int. Cl.[5] ..... G03G 5/10

[52] U.S. Cl. ..... 430/133; 430/115; 430/57; 427/218; 427/475

[58] Field of Search ..... 430/115, 355, 133, 57, 430/128; 427/30, 34, 218

[56] References Cited

U.S. PATENT DOCUMENTS 3,148,084 9/1964 Hill et al. ..... 430/133
4,835,079 5/1989 Fujimura et al. ..... 430/133
4,966,824 10/1990 Niv et al. ..... 430/115
4,974,964 12/1990 Yoshihara et al. ..... 366/152

FOREIGN PATENT DOCUMENTS 50-75042 6/1975 Japan .

*Primary Examiner*—Marion E. McCamish
*Assistant Examiner*—S. Rosasco
*Attorney, Agent, or Firm*—Fitzpatrick, Cella, Harper & Scinto

[57] ABSTRACT

A process of producing an electrophotographic photosensitive member which can be used in many copying machines and printers is here disclosed, and this process comprises the step of spraying two or more kinds of charge generating materials on an electroconductive support by a coating apparatus in which each of independent spray devices is disposed for each of the charge generating materials, in order to form a photosensitive layer containing the two or more kinds of charge generating materials on the electroconductive support, whereby the electrophotographic photosensitive member is obtained in which the photosensitive layer is formed on the electroconductive support.

9 Claims, 1 Drawing Sheet

PROCESS OF PRODUCING-ELECTROPHOTOGRAPHIC PHOTOSENSITIVE MEMBER

BACKGROUND OF THE INVENTION

1. Field of the Invention

The present invention relates to a process of producing an electrophotographic photosensitive member, and more specifically, it relates to a process of producing an electrophotographic photosensitive member having a photosensitive layer containing two or more kinds of charge generating materials.

2. Related Background Art

In recent years, various kinds of organic photoconductive materials for electrophotography have been developed, and electrophotographic photosensitive members using the organic photoconductive materials are carried in many copying machines and printers.

The organic photoconductive materials have a relatively high degree of freedom of molecular design and also permit spectrosensitive design. However the organic photoconductive materials having sufficient sensitivity to a semiconductor laser beam are not abundant. Here, the above-mentioned semiconductor laser beam has an oscillating wave length of from about 780 to 800 nm which can be used in laser beam printers and laser facsimiles to which much attention is paid these days. Additionally, the spectrosensitivity range of the organic photoconductive materials is limited.

For example, in designing an electrophotographic photosensitive member which is equipped with the composite function of the copying machine using plain paper and the laser beam printer or laser facsimile, sufficient spectrosensitivity is required in an expanded range inclusive of from a visible range of about 400 nm to an infrared range of about 800 nm which is the wave length range of the semiconductor laser beam. However it is difficult to obtain such a spectrosensitivity from a single charge generating material.

In view of the foregoing, it can be conceived to combine a plurality of charge generating materials which are sensitive in different wave length ranges, for example, a material having excellent sensitivity to visible light and another material having excellent sensitivity to long wave length light. However the following points make it very difficult to obtain a suitable mixing condition of the plural materials in a photosensitive layer.

That is, the photosensitive layer can usually be formed by coating an electroconductive support with a coating solution containing the organic photoconductive materials, a binder resin and a solvent. However, when the two or more kinds of charge generating materials are present in one coating solution, the charge generating materials agglomerate owing to the difference between their $\zeta$ potentials, and as a result, they precipitate. Additionally, in such a case, a suitable solvent for each may be different depending on the nature of the charge generating materials, so that the crystal conversion of the charge generating materials may occur. For these reasons, it is difficult for all the charge generating materials to be stably present in the coating solution.

Furthermore, in case that each of the coating solutions is prepared for each of the charge generating materials and the electroconductive support is coated in turn with the coating solutions in accordance with a dip-coating process, the lower charge generating layer dissolves out, depending upon the kinds of binder resin and solvent to be used. Consequently stable electrophotographic characteristics cannot be obtained.

Moreover, when a curable resin is used in the layer containing the charge generating materials with the intention of removing the above-mentioned drawbacks, the formation of a three-dimensional structure is impeded by the charge generating materials present in the resin. Even if the resin is cured, the resistance of the layer increases, with the result that the electrophotographic characteristics deteriorate. Additionally, in case that a curing agent or the like is contained in the layer, there is still the problem that the electrophotographic characteristics are poor.

An example in which a plurality of charge generating materials are used is disclosed in Japanese Patent Laid-open No. 50-75042. In this example, the charge generating layer may be formed by means of spray coating. However, this publication does not refer to solving a technical problem of the present invention such as the agglomeration of the charge generating materials in the coating solution. In the publication, there are neither a description regarding independent spray devices for the respective charge generating materials nor a detailed description of these spray devices.

SUMMARY OF THE INVENTION

An object of the present invention is to provide a process of producing an electrophotographic photosensitive member having stable electrophotographic characteristics in an extensive range from a short wave length range to a long wave length range.

According to the present invention, there is provided a process of producing an electrophotographic photosensitive member which comprises the step of spraying two or more kinds of charge generating materials on an electroconductive support by a coating apparatus in which each of independent spray devices is disposed for each of the charge generating materials, in order to form a photosensitive layer containing the two or more kinds of charge generating materials on the electroconductive support, whereby the electrophotographic photosensitive member is obtained in which the photosensitive layer is formed on the electroconductive support.

DETAILED DESCRIPTION OF THE PREFERRED EMBODIMENTS

The present invention will be described in detail in reference to FIGS. 1 and 2 in which coating apparatus are shown.

Figure 1:
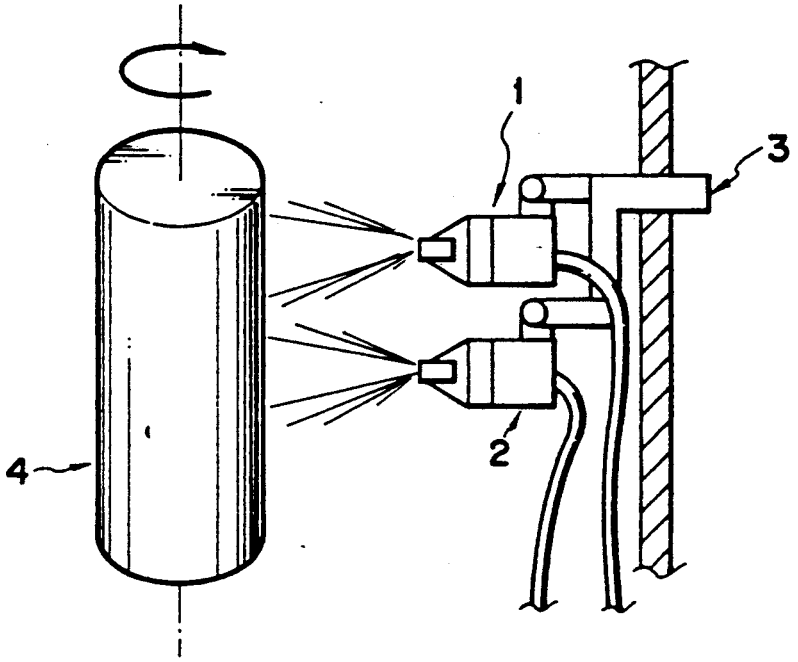
FIGS. 1 and 2 show schematic constitutional examples of coating apparatus used in the present invention.
Figure 2:
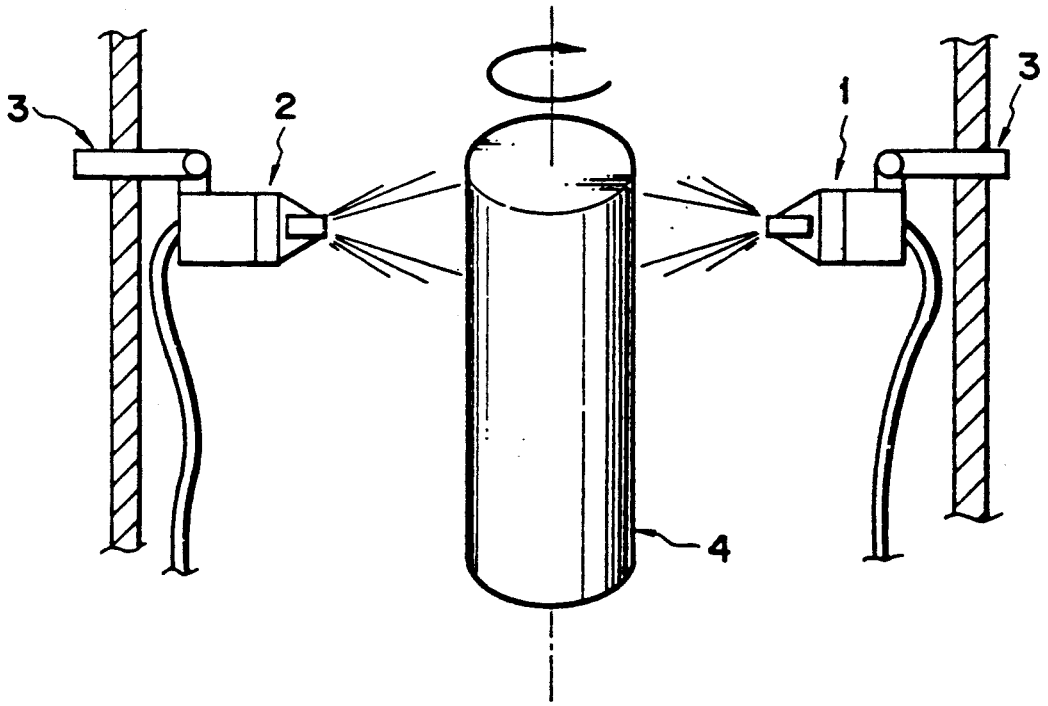

FIG. 1 shows the schematic constitution of the coating apparatus in which spray devices 1 and 2 are disposed at upper and lower positions, and FIG. 2 shows the schematic constitution of the coating apparatus in which the spray devices 1 and 2 are disposed horizontally so as to face each other.

The spray device 1 is fed with a coating solution containing a charge generating material having excellent sensitivity in the range of from short wave length to middle wave length, and the spray device 2 is fed with a coating solution containing a charge generating material having excellent sensitivity in a long wave range.

The spray condition, spray amount and spray angle of the spray devices 1 and 2 can be adjusted optionally, and these spray devices can also be moved up and down by a lift 3. Furthermore, an electroconductive support 4 can be rotated in a direction of the arrow, and therefore uniform and proper coating can always be achieved. This coating apparatus permits formation of an optional and preferable coating film which is a photosensitive layer.

For example, in the coating apparatus shown in FIG. 1, if the spray devices 1 and 2 are disposed so that the two coating materials sprayed through the spray devices 1 and 2 are not blended with each other before and after these coating materials reach the electroconductive support, the two kinds of coating materials can be superposed on each other without mixing, in order to form a laminate comprising two layers. On the contrary, if the spray devices 1 and 2 are disposed so that the two coating materials are completely blended with each other before they reach the electroconductive support, one layer can be formed in which the two kinds of charge generating materials are contained. Needless to say, it is also possible to form a layer having a middle structure between the above-mentioned laminate and single layer. Furthermore, in the other coating apparatus shown in FIG. 2, the electroconductive support can be rotated at a suitable speed, which permits obtaining a laminate structure comprising two or more coating films.

As described above, according to the present invention, it is not necessary that the plurality of charge generating materials are mixed with each other prior to the coating step. Consequently, one can prevent the above-mentioned problems, i.e., the agglomeration of the different charge generating materials, the precipitation of the charge generating materials which results from the agglomeration, the formation of the coarse photosensitive layer, the deterioration of electrophotographic characteristics due to the change in the crystal form of the charge generating materials, and the like. In addition, according to the present invention, the photosensitive layers having such various structures as described above can be formed, and therefore even electrophotographic characteristics can be controlled.

In the present invention, it is preferred that the charge generating material having the sensitivity in a shorter wave length range is mainly present in the vicinity of the surface of the layer, because a short wave length beam cannot reach a deep portion of the photosensitive layer as easily as a long wave length beam.

In the present invention, the photosensitive layer may be of a laminate structure type in which functions are shared between a charge generating layer and a charge transporting layer, or a single layer type in which the charge generating materials and a charge transporting material are contained together.

The charge generating layer can be formed by first dispersing the charge generating material in a binder resin by the use of a suitable solvent, and then coating the electroconductive support with the resulting dispersion by means of the spray apparatus. Here, examples of the charge generating material include azo pigments such as Sudan Red, Dian Blue and Dienas Green B, quinone pigments such as Algol Yellow, pyrenequinone and Indanthrene Brilliant Violet RRP, a quinocyanine pigment, a perylene pigment, indigo pigments such as indigo and thioindigo, a bisbenzoimidazole pigment such as indo fast orange toner, phthalocyanine pigments such as copper phthalocyanine and oxytitanium phthalocyanine, and a quinacridone pigment. Furthermore, examples of the above-mentioned binder resin include polyvinyl butyral, polystyrene, polyvinyl chloride, polyvinyl acetate, acrylic resin, polyvinyl pyrrolidone, methyl cellulose and hydroxypropylmethyl cellulose.

No particular restriction is put on the charge generating materials used in the present invention, but the charge generating materials having excellent sensitivity in different wave length ranges are preferable. In particular, a combination of the charge generating materials having excellent sensitivity in a visible light range and the other charge generating material having excellent sensitivity in a laser beam range (long wave length range) is preferable.

The thickness of the charge generating layer is preferably 5 μm or less, more preferably from 0.01 to 2 μm.

The above-mentioned charge transporting layer can be formed by using a coating solution which is prepared by dissolving the charge transporting material in a resin having layer-forming properties, and examples of the charge transporting material include polycyclic aromatic compounds such as anthracene, pyrene, phenanthrene and coronene, nitrogen-containing cyclic compounds such as indole, carbazole, oxazole, isooxazole, thiazole, imidazole, pyrazole, oxadiazole, pyrazoline, thiadiazole and triazole, hydrazone compounds and styryl compounds. The reason why the charge transporting material is dissolved in the above-mentioned resin is that the charge transporting material is generally a low-molecular weight compound, and therefore it has poor layer-forming properties by itself.

Examples of the resin for dissolving the charge transporting material therein include polyester, polysulfone, polycarbonate, polymethacrylate ester and polystyrene.

The thickness of the charge transporting layer is preferably from 5 to 40 μm, more preferably 10 to 25 μm.

In the present invention, the charge generating layer may be disposed on or under the charge transporting layer.

In case that the photosensitive layer is a single layer, the thickness of this layer is preferably from 5 to 40 μm, more preferably from 10 to 30 μm.

In the present invention, an undercoat layer having an adhesive function and a barrier function may be interposed between the electroconductive support and the photosensitive layer.

Examples of the material for the undercoat layer include polyvinyl alcohol, polyethylene oxide, ethyl cellulose, methyl cellulose, casein, polyamide, glue and gelatin.

When used, such material is first dissolved in a suitable solvent, and then applied onto the electroconductive support. The thickness of the undercoat layer is in the range of from 0.2 to 3.0 μm.

Furthermore, in the present invention, a resin layer not containing or containing dispersed electroconductive particles can be provided as a protective layer on the photosensitive layer.

The electroconductive support used in the present invention may be made from any material, so long as it has electroconductivity. Examples of the material for the electroconductive support include metals such as aluminum, copper, molybdenum, chromium, nickel and brass which are molded into the form of a drum or sheet, laminates prepared by superposing a plastic film on a metal foil of aluminum or copper, plastic films on which aluminum, indium oxide or tin oxide is vapor-deposited, the above-mentioned metals, plastic films and papers having an electroconductive layer thereon prepared by applying a binder resin containing an electroconductive material.

EXAMPLE 1

In the first place, coating solutions (1) and (2) containing the charge generating materials were prepared in the following manner.

Preparation of the charge generating material-containing coating solution (1):

To 100 parts by weight of cyclohexanone were added 4 parts by weight of oxytitanium phthalocyanine represented by the formula

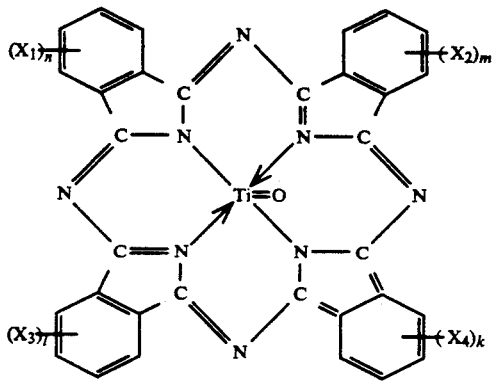

wherein X is Cl, and each of n, m, l and K is an integer of from 0 to 4, and 2 parts by weight of polyvinyl butyral, and they were then dispersed for 2 hours in a sand mill in which glass beads having a diameter of 1 mm were used. Next, 1,000 parts by weight of methyl ethyl ketone was further added thereto for dilution.

Preparation of the charge generating material-containing coating solution (2):

To 100 parts by weight of cyclohexanone were added 4 parts by weight of a disazo pigment represented by the formula

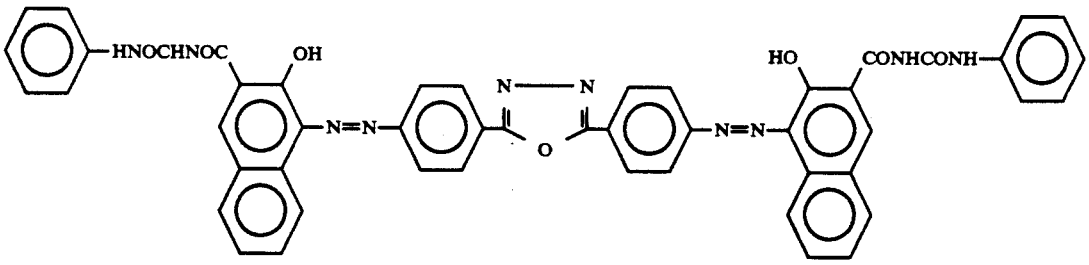

and 2 parts by weight of polyvinyl butyral, and they were then dispersed for 2 hours in a sand mill in which glass beads having a diameter of 1 mm were used. Afterward, 1,000 parts by weight of tetrahydrofuran was further added thereto for dilution.

Next, an aluminum cylinder having a diameter of 80 mm as an electroconductive support was formed with charge generating layers by coating the aluminum cylinder with the above-mentioned coating materials in the following manner. A coating apparatus shown in FIG. 1 was used, and the charge generating material-containing coating solution (1) was fed to a spray device 2 and the charge generating material-containing coating solution (2) was fed to a spray device 1. These spray devices were adjusted so that the respective coating solutions were not blended with each other. That is, an adjustment was made so as to obtain a laminate structure in which the layer of the charge generating material-containing coating solution (1) was formed on the layer of the charge generating material-containing coating solution (2). In this case, the amount of the charge generating material-containing coating solution (1) was 80 mg/m$^2$ and that of the charge generating material-containing coating solution (2) was 100 mg/m$^2$. Furthermore, the rotational speed of the electroconductive support was 300 rpm.

The thus formed charge generating layers were then coated in accordance with a dip-coating process with a solution prepared by dissolving 10 parts by weight of a charge transporting material represented by the formula

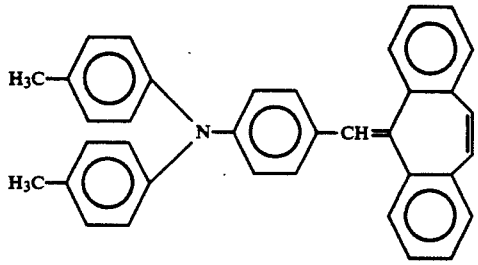

and 10 parts by weight of bisphenol Z type polycarbonate in 60 parts by weight of chlorobenzene, followed by drying at 110° C. for 1 hour, in order to form a charge transporting layer having a thickness of 20 μm on the charge generating layers. Thus, an electrophotographic photosensitive member was produced.

This photosensitive member was disposed in a copying machine (trade name: NP-4835, manufactured by Canon) using plain paper on which a laser beam was carried, and measurements were then made to obtain the values of a light portion potential Vl by visible light having a luminous energy of 1.8 lux·sec, a light portion potential Vbl by a laser beam (wave length 802 nm) having an output of 8 mV and a potential (residual potential) Vr after preexposure under a luminous energy of 15 lux·sec.

In this case, a dark potential Vd was adjusted to −650V.

The results are set forth in Table 1.

EXAMPLE 2

The same procedure as in Example 1 was carried out except that spray devices were adjusted so that the charge generating material-containing coating solutions (1) and (2) were completely blended, thereby preparing an electrophotographic photosensitive member. Evaluation was then made for the member.

The results are set forth in Table 1.

COMPARATIVE EXAMPLE 1

The same procedure as in Example 1 was carried out except that the charge generating material-containing coating solutions (1) and (2) were mixed and then sprayed through the same, single spray device, thereby preparing an electrophotographic photosensitive member. Afterward, an evaluation was made for the member.

The results are set forth in Table 1.

COMPARATIVE EXAMPLE 2

The same procedure as in Example 1 was carried out except that a mixture of the charge generating material-containing coating solutions (1) and (2) were applied by the use of a dip-coating process, thereby preparing an electrophotographic photosensitive member.

In this case, 100 parts by weight of methyl ethyl ketone and 100 parts of tetrahydrofuran were used as dilute solvents so that coating amounts of the coating solutions (1) and (2) were 80 mg/m$^2$ and 100 mg/m$^2$, respectively, and so that the total amount of these coating solutions was 180 mg/m$^2$.

The results are set forth in Table 1.

EXAMPLE 3

The same procedure as in Example 1 was carried out except that the charge generating material-containing coating solutions (1) and (2) were applied by the use of a coating apparatus shown in FIG. 2, thereby preparing an electrophotographic photosensitive member. Evaluation was then made for the member.

In this case, the coating amounts of the coating solutions (1) and (2) were adjusted to 80 mg/m$^2$ and 100 mg/m$^2$, respectively, in the same manner as in Example 1.

The results are set forth in Table 1.

COMPARATIVE EXAMPLE 3

The same procedure as in Example 1 was carried out except that an electroconductive support was coated with the charge generating material-containing coating solutions (1) and (2) in the order of the solution (1) and the solution (2) in accordance with a dip-coating process, thereby preparing an electrophotographic photosensitive member. Evaluation was then made for the member.

The results are set forth in Table 1.

COMPARATIVE EXAMPLE 4

The same procedure as in Example 3 was carried out except that an electroconductive support was coated with the charge generating material-containing coating solutions (1) and (2) in the converse order, i.e., in such an order that the layer of the solution (10 became an upper layer, thereby preparing an electrophotographic photosensitive member. Evaluation was then made for the member.

The results are set forth in Table 1.

EXAMPLE 4

A coating solution was prepared by adding 6 parts by weight of the same charge transporting material as used in Example 1 and 6 parts by weight of bisphenol A type polycarbonate to the charge generating material-containing coating solution (1).

Similarly, another coating solution was prepared by adding 6 parts by weight of the above-mentioned charge transporting material and 6 parts by weight of bisphenol A type polycarbonate to the charge generating material-containing coating solution (2).

A photosensitive layer was then formed from the thus prepared coating solutions on an electroconductive support by the use of a coating apparatus shown in FIG. 1. In this case, spray devices in the coating apparatus were adjusted so that the two coating solutions might be mixed and so that the thickness of the dried layer might be 5 μm. Incidentally, the rotational speed of the electroconductive support was 100 rpm.

The results are set forth in Table 1.

TABLE 1

| | Vd (−V) | Vl (−V) | Vbl (−V) | Vr (−V) |
|---|---|---|---|---|
| Example 1 | 650 | 115 | 85 | 25 |
| Example 2 | 650 | 130 | 90 | 25 |
| Example 3 | 650 | 130 | 90 | 25 |
| Example 4 | 650 | 200 | 150 | 25 |
| Comp. Ex. 1 | 650 | 130 | 280 | 35 |
| Comp. Ex. 2 | 650 | 130 | 290 | 35 |
| Comp. Ex. 3 | 650 | 130 | 210 | 35 |
| Comp. Ex. 4 | 650 | 240 | 70 | 45 |

We claim:

1. A process of producing an electrophotographic photosensitive member which comprises the step of spraying two or more kinds of charge generating materials on an electroconductive support by a coating apparatus in which each of independent spray devices is disposed for each of said charge generating materials, in order to form a photosensitive layer containing said two or more kinds of charge generating materials on said electroconductive support, whereby said electrophotographic photosensitive member is obtained in which said photosensitive layer is formed on said electroconductive support.

2. A process of producing an electrophotographic photosensitive member according to claim 1, wherein said two or more kinds of charge generating materials have sensitivity in mutually different wave length ranges.

3. A process of producing an electrophotographic photosensitive member according to claim 1, wherein said photosensitive layer is a laminate structure comprising a charge generating layer and a charge transporting layer.

4. A process of producing an electrophotographic photosensitive member according to claim 3, wherein said charge generating layer is a laminate structure comprising layers corresponding to said respective kinds of contained charge generating materials.

5. A process of producing an electrophotographic photosensitive member according to claim 4, wherein said charge generating layer is a laminate structure in which said layer containing said charge generating material having sensitivity in a shorter wave length range is an upper layer.

6. A process of producing an electrophotographic photosensitive member according to claim 3, wherein said charge generating layer is a single layer.

7. A process of producing an electrophotographic photosensitive member according to claim 1, wherein said photosensitive layer is a single layer.

8. A process of producing an electrophotographic photosensitive member according to claim 1, wherein said electrophotographic photosensitive member has an undercoat layer between said electroconductive support and said photosensitive layer.

9. A process of producing an electrophotographic photosensitive member according to claim 1, wherein said electrophotographic photosensitive member has a protective layer on said photosensitive layer.

* * * * *